US011047558B2

(12) United States Patent
Doheny et al.

(10) Patent No.: US 11,047,558 B2
(45) Date of Patent: Jun. 29, 2021

(54) IN-LINE ADAPTERS FOR LIGHT FIXTURES

(71) Applicant: SIGNIFY HOLDING B.V., Eindhoven (NL)

(72) Inventors: Seth Doheny, Newnan, GA (US); Jyoti Kumar, Tyrone, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/596,213

(22) Filed: Oct. 8, 2019

(65) Prior Publication Data

US 2021/0102692 A1 Apr. 8, 2021

(51) Int. Cl.

| | |
|---|---|
| ***H01R 33/08*** | (2006.01) |
| ***F21V 23/06*** | (2006.01) |
| ***F21V 23/02*** | (2006.01) |
| ***H01R 31/06*** | (2006.01) |
| ***F21V 23/04*** | (2006.01) |

(52) U.S. Cl.

CPC ..... *F21V 23/06* (2013.01); *F21V 23/023* (2013.01); *F21V 23/0435* (2013.01); *F21V 23/0442* (2013.01); *H01R 31/065* (2013.01)

(58) Field of Classification Search

CPC .... F21V 23/06; F21V 23/023; F21V 23/0442; F21V 23/043; H01R 31/065

USPC ..... 439/620.02

See application file for complete search history.

(56) References Cited

U.S. PATENT DOCUMENTS

| | | | | |
|---|---|---|---|---|
| 9,644,828 | B1 * | 5/2017 | May | H01R 33/94 |
| 10,190,761 | B1 * | 1/2019 | Winters | F21V 23/02 |
| 10,401,007 | B1 * | 9/2019 | York | F21V 15/01 |
| 2010/0301781 | A1 * | 12/2010 | Budike, Jr. | H05B 47/19 315/362 |
| 2012/0139426 | A1 * | 6/2012 | Ilyes | H05B 47/105 315/152 |
| 2014/0268733 | A1 * | 9/2014 | Holland | F21V 7/0008 362/231 |
| 2015/0198324 | A1 * | 7/2015 | O'Brien | F21V 7/04 362/294 |
| 2016/0040839 | A1 * | 2/2016 | Driscoll | F21V 29/767 362/294 |
| 2016/0330825 | A1 * | 11/2016 | Recker | H05B 47/19 |
| 2017/0105272 | A1 * | 4/2017 | Johnson | H05B 47/175 |
| 2017/0198896 | A1 * | 7/2017 | May | F21K 9/272 |
| 2017/0307143 | A1 * | 10/2017 | Shah | F21K 9/90 |
| 2018/0035510 | A1 * | 2/2018 | Doheny | H05B 45/46 |
| 2018/0156437 | A1 * | 6/2018 | Freer | H05B 47/19 |
| 2019/0242562 | A1 * | 8/2019 | Chien | F21V 19/0015 |
| 2019/0253670 | A1 * | 8/2019 | Chien | F21S 4/28 |

(Continued)

*Primary Examiner* — Abdullah A Riyami
*Assistant Examiner* — Nelson R. Burgos-Guntin

(57) ABSTRACT

A resulting light fixture can include a base light fixture having at least one light source and at least one first coupling feature, where the first coupling feature is configured to detachably couple to a second coupling feature of a power source. The resulting light fixture can further include an in-line adapter having at least one light fixture component, a third coupling feature, and a fourth coupling feature, where the third coupling feature is detachably coupled to the first coupling feature of the base light fixture, where the fourth coupling feature is configured to detachably couple to the second coupling feature of the power source, and where the at least one light fixture component provides a capability absent in the base light fixture.

20 Claims, 6 Drawing Sheets

(56) References Cited

U.S. PATENT DOCUMENTS

| | | | | |
|---|---|---|---|---|
| 2019/0301689 | A1* | 10/2019 | Hetrick | F21S 2/005 |
| 2019/0318697 | A1* | 10/2019 | Kumar | H05B 47/11 |
| 2019/0341793 | A1* | 11/2019 | Chien | F21V 23/023 |

* cited by examiner

IN-LINE ADAPTERS FOR LIGHT FIXTURES

TECHNICAL FIELD

The present disclosure relates generally to control systems for light fixtures, and more particularly to systems, methods, and devices for in-line adapters for light fixtures.

BACKGROUND

Many existing light fixtures that are installed in a building, home, or other structure have been in place for years. A number of these light fixtures were manufactured and installed before many of the technological advancements in light fixtures evolved. For example, a number of these light fixtures can only be manually controlled, while many of the recent light fixtures allow for remote user control. As another example, a light fixture may lack sufficient power supply, sensing capability, and/or control functions. Replacing the existing light fixtures to upgrade to the new technologies can be an expensive proposition that may not have enough of a benefit for a user to replace the existing light fixtures. In other cases, light fixtures, whether new or existing, can have a common housing for multiple levels of power, multiple types of communication capability, multiple types of sensing capability, and/or other differing characteristics.

SUMMARY

In general, in one aspect, the disclosure relates to a resulting light fixture that can include a base light fixture having at least one light source and at least one first coupling feature, where the first coupling feature is configured to detachably couple to a second coupling feature of a power source. The resulting light fixture can also include an in-line adapter having at least one light fixture component, a third coupling feature, and a fourth coupling feature, where the third coupling feature is detachably coupled to the first coupling feature of the base light fixture, where the fourth coupling feature is configured to detachably couple to the second coupling feature of the power source, and where the at least one light fixture component provides a capability absent in the base light fixture.

In another aspect, the disclosure can generally relate to an in-line adapter for a light fixture that can include a first coupling feature configured to detachably couple to a second coupling feature of a power source that provides primary power. The in-line adapter can also include a third coupling feature configured to detachably couple to a fourth coupling feature of a base light fixture portion. The in-line adapter can further include an adapter housing coupled to and disposed between the first coupling feature and the second coupling feature, where the adapter housing houses at least one light fixture component. The at least one light fixture component can provide a capability absent in the base light fixture portion. The second coupling feature and the fourth coupling feature, in the absence of the first coupling feature and the third coupling feature, can be configured to detachably couple directly to each other.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1A:
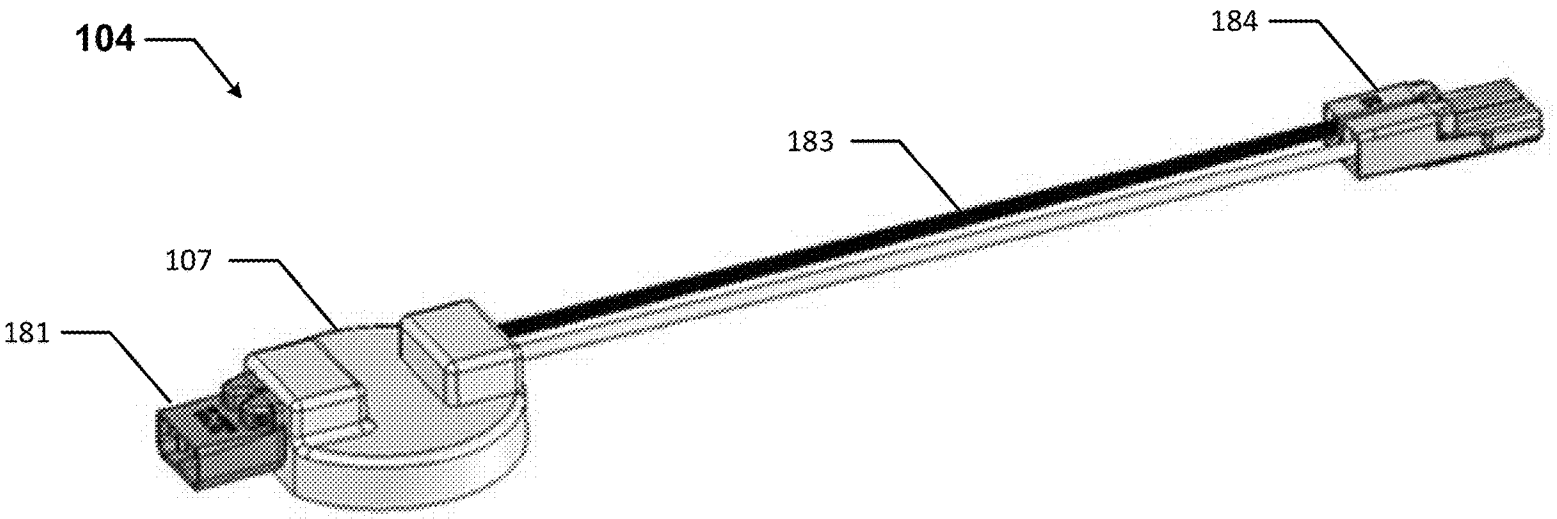
FIGS. 1A-1E show various views of an in-line adapter in accordance with certain example embodiments.

In general, example embodiments provide systems, methods, and devices for in-line adapters for new and existing light fixtures (sometimes more generally referred to a luminaires). Example in-line adapters for light fixtures provide a number of benefits. Such benefits can include, but are not limited to, prolonging the life and functionality of light fixtures, increased reliability of light fixtures, reduced power consumption, reduced number of parts, improved modularity, improved efficiency, ease of installation, ease of maintenance, and compliance with industry standards that apply to light fixtures located in certain environments. The term "light fixture" is sometimes abbreviated as "LF" herein.

Generally speaking, this application is directed to an in-line adapter for an existing or new light fixture that allows a user to replace or add the power supply, sensor devices, and/or other capabilities (e.g., lumen output, correlated color temperature (CCT)) of the light fixture without opening the housing of the light fixture. The specific examples provided herein are directed to an existing or new light fixture that is currently installed or is in the process of being installed. The example in-line adapters described herein can easily be installed, often without the use of tools, to allow the new or retrofitted light fixture to have a customized power supply, sensing, and/or other capabilities to suit the particular needs of a user. However, it is contemplated herein that example in-line adapters can be used with other types of electrical devices. Examples of other types of electrical devices can include, but are not limited to, a camera, a household appliance, a computer, and a sensor device. Therefore, example embodiments can be used with any type of electrical device and are not specifically limited to use with light fixtures.

Light fixtures with which example adapters can be used can be located in one or more of any of a number of environments. Examples of such environments can include, but are not limited to, indoors, outdoors, office space, high-humidity environments, high-temperature environments, low-temperature environments, wet environments, manufacturing plant, warehouse, storage, climate-controlled, and non-climate-controlled. In some cases, the example embodiments discussed herein can be used in any type of hazardous environment, including but not limited to an airplane hangar, a drilling rig (as for oil, gas, or water), a production rig (as for oil or gas), a refinery, a chemical plant, a power plant, a mining operation, a wastewater treatment facility, and a steel mill.

The light fixtures with example in-line adapters (including components thereof) can be made of one or more of a number of suitable materials to allow the light fixture and in-line adapter to meet certain standards and/or regulations while also maintaining durability in light of the one or more conditions under which the light fixtures and/or other associated components of the light fixture can be exposed. Examples of such materials can include, but are not limited to, aluminum, stainless steel, fiberglass, glass, plastic, ceramic, and rubber.

Example in-line adapters, or portions thereof, described herein can be made from a single piece (as from a mold, injection mold, die cast, or extrusion process). In addition, or in the alternative, example in-line adapters can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example adapter to become coupled, directly or indirectly, to a portion of an existing light fixture. A coupling feature can include, but is not limited to, a clamp, a portion of a hinge, an aperture, a recessed area, a protrusion, a hole, a slot, a tab, a detent, a connector end, and mating threads. One portion of an example in-line adapter can be coupled to a portion of a new or existing light fixture by the direct use of one or more coupling features.

In addition, or in the alternative, a portion of an example in-line adapter can be coupled to a portion of a light fixture using one or more independent devices that interact with one or more coupling features disposed on a component of the adapter. Examples of such devices can include, but are not limited to, a pin, a hinge, a fastening device (e.g., a bolt, a screw, a rivet), epoxy, glue, adhesive, and a spring. One coupling feature described herein can be the same as, or different than, one or more other coupling features described herein. A complementary coupling feature as described herein can be a coupling feature that mechanically couples, directly or indirectly, with another coupling feature.

In the foregoing figures showing example embodiments of in-line adapters for light fixtures, one or more of the components shown may be omitted, repeated, and/or substituted. Accordingly, example embodiments of in-line adapters for light fixtures should not be considered limited to the specific arrangements of components shown in any of the figures. For example, features shown in one or more figures or described with respect to one embodiment can be applied to another embodiment associated with a different figure or description.

In certain example embodiments, light fixtures having example in-line adapters are subject to meeting certain standards and/or requirements. For example, the National Electric Code (NEC), the National Electrical Manufacturers Association (NEMA), the International Electrotechnical Commission (IEC), the Federal Communication Commission (FCC), Underwriters Laboratories (UL), and the Institute of Electrical and Electronics Engineers (IEEE) set standards as to electrical enclosures, wiring, and electrical connections. Use of example embodiments described herein meet (and/or allow the resulting light fixture to meet) such standards when applicable.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number, and corresponding components in other figures have the identical last two digits.

In addition, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of in-line adapters for light fixtures will be described more fully hereinafter with reference to the accompanying drawings, in which example embodiments of in-line adapters for light fixtures are shown. In-line adapters for light fixtures may, however, be embodied in many different forms and should not be construed as limited to the example embodiments set forth herein. Rather, these example embodiments are provided so that this disclosure will be thorough and complete, and will fully convey the scope of in-line adapters for light fixtures to those of ordinary skill in the art. Like, but not necessarily the same, elements (also sometimes called components) in the various figures are denoted by like reference numerals for consistency.

Terms such as "first", "second", "above", "below", "distal", "proximal", "end", "top", "bottom", "side", and "within" are used merely to distinguish one component (or part of a component or state of a component) from another. Such terms are not meant to denote a preference or a particular orientation. Such terms are not meant to limit embodiments of in-line adapters for light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
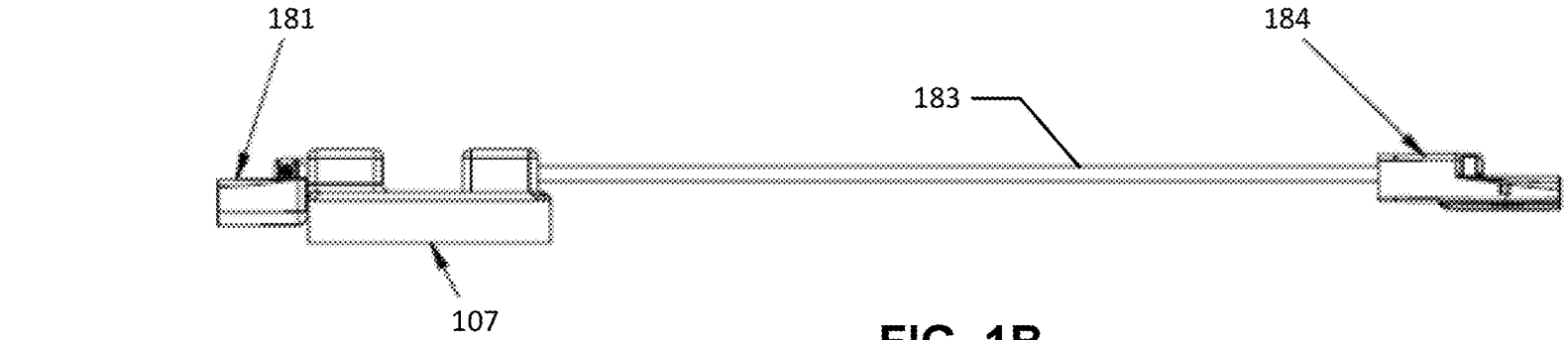
Figure 1C:
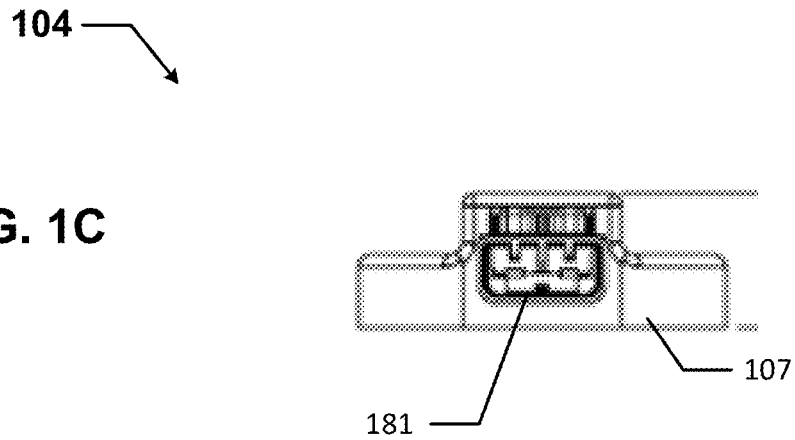
Figure 1D:
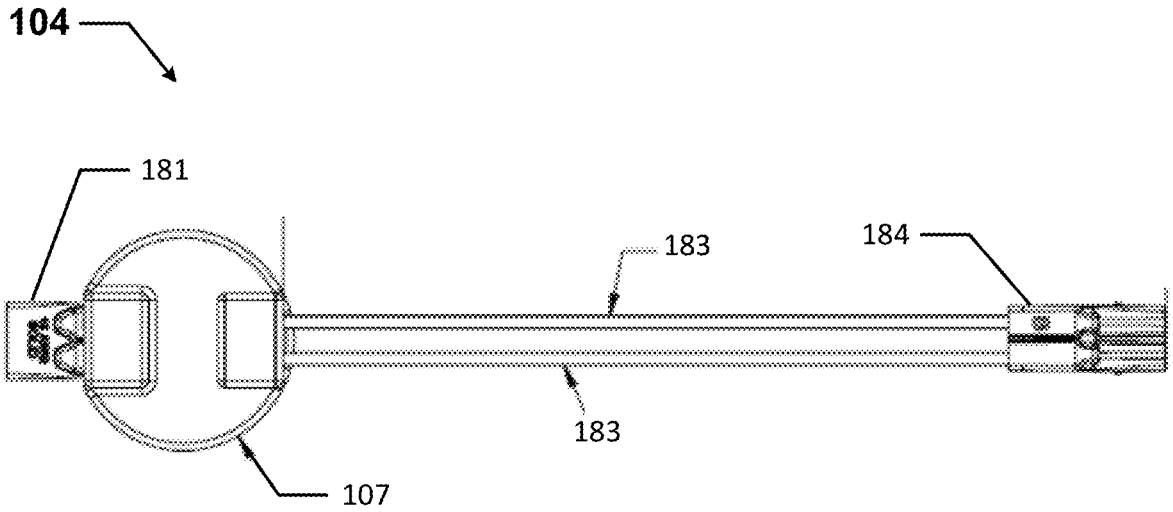
Figure 1E:
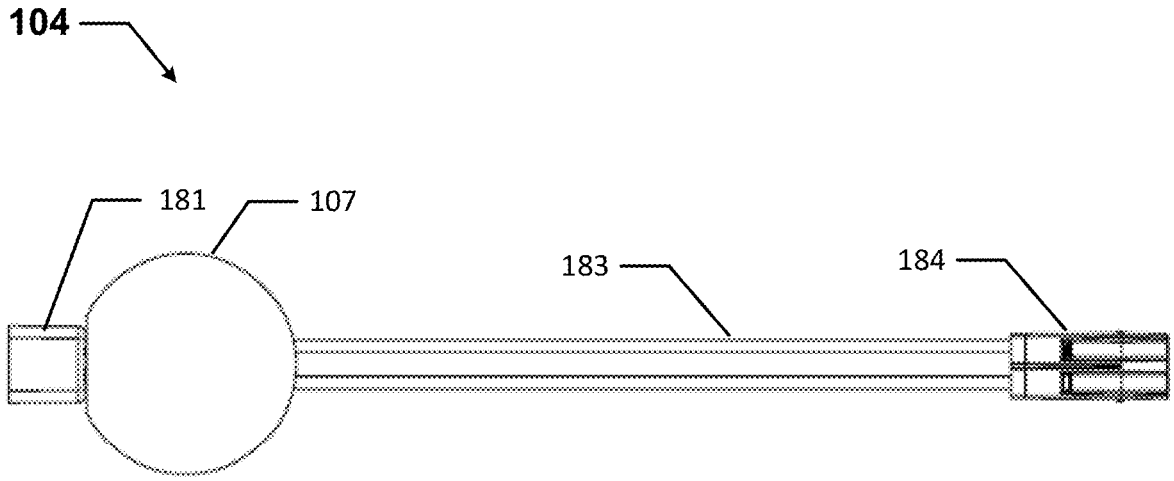

FIGS. 1A through 1E show various views of an in-line adapter 104 in accordance with certain example embodiments. Specifically, FIG. 1A shows a top-side perspective view of the in-line adapter 104. FIG. 1B shows a side view of the in-line adapter 104. FIG. 1C shows a front view of the in-line adapter 104. FIG. 1D shows a top view of the in-line adapter 104. FIG. 1E shows a bottom view of the in-line adapter 104. Referring to FIGS. 1A through 1E, the in-line adapter 104 can include one or more of a number of components. For example, the in-line adapter 104 in this case includes an adapter housing 107, a first coupling feature 181, a second coupling feature 184, and one or more electrical wires 183.

The adapter housing 107 houses one or more of a number of components therein. Such components can include, but are not limited to, a power supply, a control module, a sensor device, and a communications package. More details about the adapter housing 107 and the components of the in-line adapter 104 are described in more detail below with respect to FIG. 4.

The coupling feature 181 of the adapter 104 can be any type of coupling feature that both electrically and mechanically couples to a component (e.g., a power source that delivers AC mains or other form of primary power) of a light fixture. In this example, the coupling feature 181 is an electrical connector end that is configured to couple to a complementary electrical connector end of a light fixture. The coupling feature 181 can be disposed on the adapter housing 107, as shown in FIGS. 1A through 1E. Alternatively, the coupling feature 181 can be located remotely from the adapter housing 107. In such a case, the coupling feature 181 can be electrically coupled to the adapter housing 107 (or, more specifically, one or more components within the adapter housing 107) using one or more electrical wires, such as electrical wires 183.

The coupling feature 184 of the adapter 104 can be any type of coupling feature that both electrically and mechanically couples to another component (e.g., one or more light sources) of a light fixture. In this example, the coupling feature 184 is an electrical connector end that is configured to couple to a complementary electrical connector end of a light fixture. The coupling feature 184 can be disposed on the adapter housing 107. Alternatively, as shown in FIGS. 1A through 1E, the coupling feature 184 can be located remotely from the adapter housing 107. In such a case, the coupling feature 184 can be electrically coupled to the adapter housing 107 (or, more specifically, one or more components within the adapter housing 107) using one or more electrical wires 183. The electrical wires 183 provide a flexible connection between coupling feature 184 and the adapter housing 107.

In certain example embodiments, coupling feature 184 can be configured as the complement of coupling feature 181. In other words, with the light fixture for which the example adapter 104 is used, there can be two coupling features that are coupled to each other. For example, a power supply that delivers AC mains or other form of primary power can have a coupling feature (e.g., an electrical connector end) that is detachably coupled to a complementary coupling feature (e.g., a complementary electrical connector end) of a power supply (e.g., a driver) that receives the primary power (or some derivation thereof) for use by other components (e.g., light sources) of the light fixture. In such a case, to accommodate the example adapter 104, such coupling features of the light fixture are decoupled from each other, allowing for one coupling feature 181 of the adapter 104 to become coupled to one of those coupling features of the light fixture and for the other coupling feature 184 of the adapter 104 to become coupled to the other of those coupling features of the light fixture.

In certain example embodiments, one or more coupling features (e.g., adhesive, apertures, tabs) can be disposed on an outer surface of the adapter housing 107 of the adapter 104. In such a case, the adapter housing 107 can be secured within a light fixture. Similarly, coupling feature 181 and/or coupling feature 184 can include one or more additional coupling features (e.g., adhesive, apertures, tabs) that can be used to secure such coupling feature within a light fixture.

Figure 2:
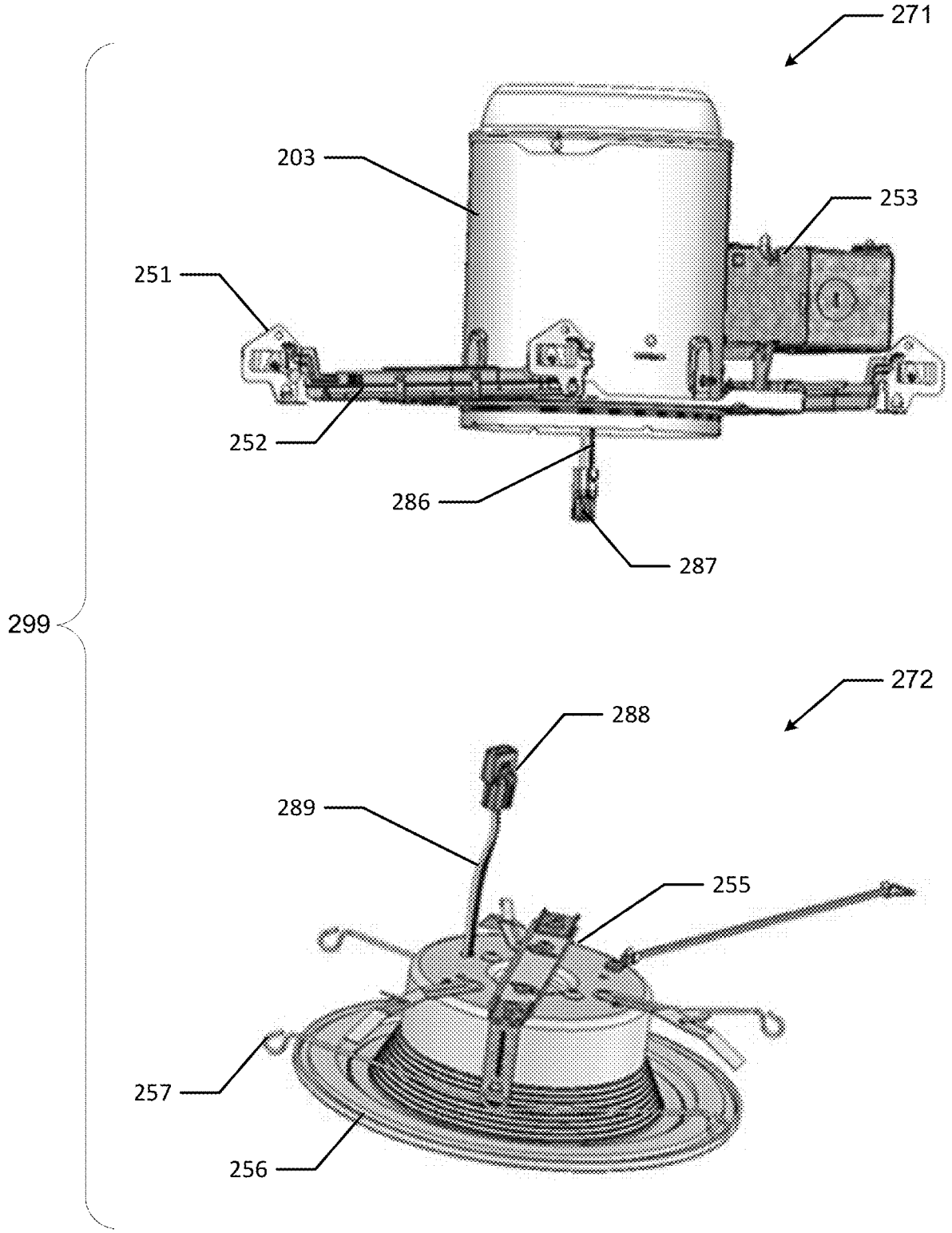
FIG. 2 shows a partially disassembled base light fixture with which example embodiments can be used.

FIG. 2 shows a partially disassembled base light fixture 299 with which example embodiments can be used. Referring to FIGS. 1A through 2, the base light fixture 299 of FIG. 2 shows a first portion 271 that is separated (disconnected) from a second portion 272. The first portion 271 of the base light fixture 299 in this case includes a housing 203, a junction box 253, a plaster frame 252, and mounting brackets 251. Since the second portion 272 of the base light fixture 299 is separated from the first portion 271, the bottom of the housing 203 is exposed and open. This allows for one or more electrical wires 286, disposed within the housing 203, to extend below the housing 203. At the distal end of the electrical wires 286 is disposed a coupling feature 287 (in this case, an electrical connector end). The proximal end of the electrical wires 286 are coupled to a component (e.g., a power source that delivers AC mains or other form of primary power, a controller) of the light fixture 299.

The second portion 272 of the base light fixture 299 in this case includes a housing 255, a trim assembly 256, and mounting features 257 (in this case, torsion springs) for mechanically securing the second portion 272 of the base light fixture 299 to the first portion 271. Since the first portion 271 of the base light fixture 299 is separated from the second portion 272, the top of the housing 255 is exposed. As a result, one or more electrical wires 289 are visible. At the proximal end of the electrical wires 289 is disposed a coupling feature 288 (in this case, an electrical connector end). The distal end of the electrical wires 289 are coupled to another component (e.g., one or more light sources) of the base light fixture 299 disposed within the housing 255 of the second portion 272.

Coupling feature 287 of the first portion 271 of the base light fixture 299 complements coupling feature 288 of the second portion 272 of the base light fixture 299. When the first portion 271 and the second portion 272 of the base light fixture 299 if fully assembled, coupling feature 287 can couple directly to coupling feature 288. When this occurs, coupling feature 287 and coupling feature 288 are both electrically and mechanically coupled to each other. Alternatively, an example in-line adapter (discussed below) can be disposed between the first portion 271 and the second portion 272 of the base light fixture 299 by coupling to coupling feature 287 and coupling feature 288. An example of this is shown below with respect to FIGS. 3 and 4.

The base light fixture 299 in this case can lack one or more components (e.g., a power supply, a sensor) that can be used in the operation of the resulting light fixture. In addition, or in the alternative, a user may want to add some capability (e.g., sensing, communication) that is used in by some other device or system unrelated to the light fixture 299. Either of these can be accomplished by adding an example in-line adapter to the base light fixture 299 to generate a resulting light fixture.

By completing and/or retrofitting the base light fixture 299 with an example adapter, the resulting light fixture can be able to operate and/or operate differently. Further, the resulting light fixture can have increased operational capability using the example in-line adapter. Example embodiments described herein are referred to as in-line adapters (e.g., in-line adapter 104) because they are configured to be inserted in series with some or all of a base light fixture (e.g., bases light fixture 299) to enhance the capability of the resulting light fixture.

Figure 3:
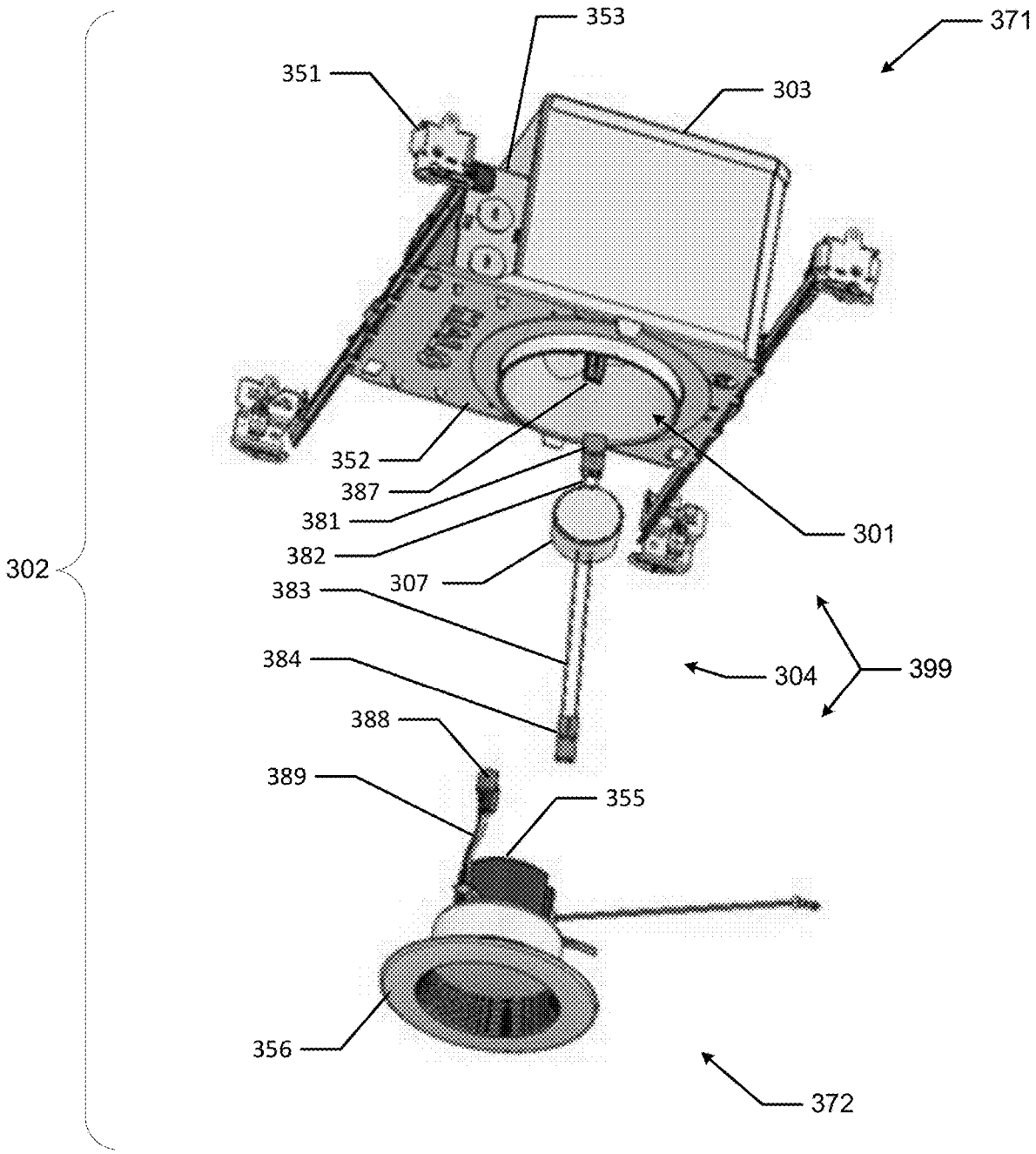
FIG. 3 shows a resulting light fixture that includes an existing light fixture and an adapter in accordance with certain example embodiments.

FIG. 3 shows a resulting light fixture 302 that includes a base light fixture 399 and an in-line adapter 304 in accordance with certain example embodiments. Referring to FIGS. 1A through 3, the base light fixture 399 (including portions thereof) of FIG. 3 is substantially similar to the base light fixture 299 (including corresponding portions thereof) of FIG. 2. For example, the base light fixture 399 of FIG. 3 has a first portion 371 that is separated (disconnected) from a second portion 372. The first portion 371 of the base light fixture 399 in this case includes a housing 303, a junction box 353, a plaster frame 352, and mounting brackets 351. Since the second portion 372 of the base light fixture 399 is separated from the first portion 371, the bottom of the housing 303 is exposed and open. This allows for one or more electrical wires (hidden from view but disposed within the cavity 301 formed by the housing 303) to extend within the cavity 301 of the housing 303. At the distal end of those electrical wires is disposed a coupling feature 387 (in this case, an electrical connector end). The proximal end of those electrical wires is coupled to a component (e.g., a power source that delivers AC mains or other form of primary power) of the base light fixture 399.

The second portion 372 of the base light fixture 399 in this case includes a housing 355 and a trim assembly 356. Since the first portion 371 of the base light fixture 399 is separated from the second portion 372, the housing 355 is open and exposed. As a result, one or more electrical wires 389 are visible. At the proximal end of the electrical wires 389 is disposed a coupling feature 388 (in this case, an electrical connector end). The distal end of the electrical wires 389 are coupled to another component (e.g., one or more light sources) of the second portion 372 of the base light fixture 399 disposed within the housing 355.

Disposed between the first portion 371 of the base light fixture 399 and the second portion 372 of the base light fixture 399 is the example in-line adapter 304. The in-line adapter 304 of FIG. 3 is substantially similar to the in-line adapter 104 of FIGS. 1A through 1E described above. For example, the in-line adapter 304 of FIG. 3 can include an adapter housing 307, a first coupling feature 381, one or more electrical wires 382, a second coupling feature 384, and one or more electrical wires 383. The electrical wires 382 were not present in the adapter 204 of FIG. 2. In this case, the electrical wires 382 provide a flexible connection between coupling feature 381 and the adapter housing 307.

As discussed above, coupling feature 384 can be configured as the complement of coupling feature 381. In other words, since coupling feature 387 and coupling feature 388 of the base light fixture 399 would normally couple to each other, to create a resulting light fixture, coupling feature 387 of the first portion 371 of the base light fixture 399 couples to coupling feature 381 of the example in-line adapter 304, and coupling feature 388 of the first portion 372 of the base light fixture 399 couples to coupling feature 384 of the example in-line adapter 304. When this occurs, the resulting light fixture 302 is formed.

After the example in-line adapter 304 is electrically and mechanically coupled to the first portion 371 and the second portion 372, the first portion 372 can be mechanically coupled to the second portion 371. In this case, when the first portion 371 and the second portion 372 are mechanically coupled to each other, the in-line adapter 304 is disposed within the cavity 301 of the housing 303 of the resulting light fixture 302. As discussed above, one or more coupling features (e.g., adhesive, apertures, tabs) can be disposed on an outer surface of the adapter housing 307, coupling feature 381, and/or coupling feature 384 of the in-line adapter 304 to secure one or more portions of the in-line adapter 304 within the cavity 301 of the housing 303 of the resulting light fixture 302. In alternative embodiments, as shown below with respect to FIG. 4, the example in-line adapter can be exposed (stand-alone) as part of the resulting light fixture.

Figure 4:
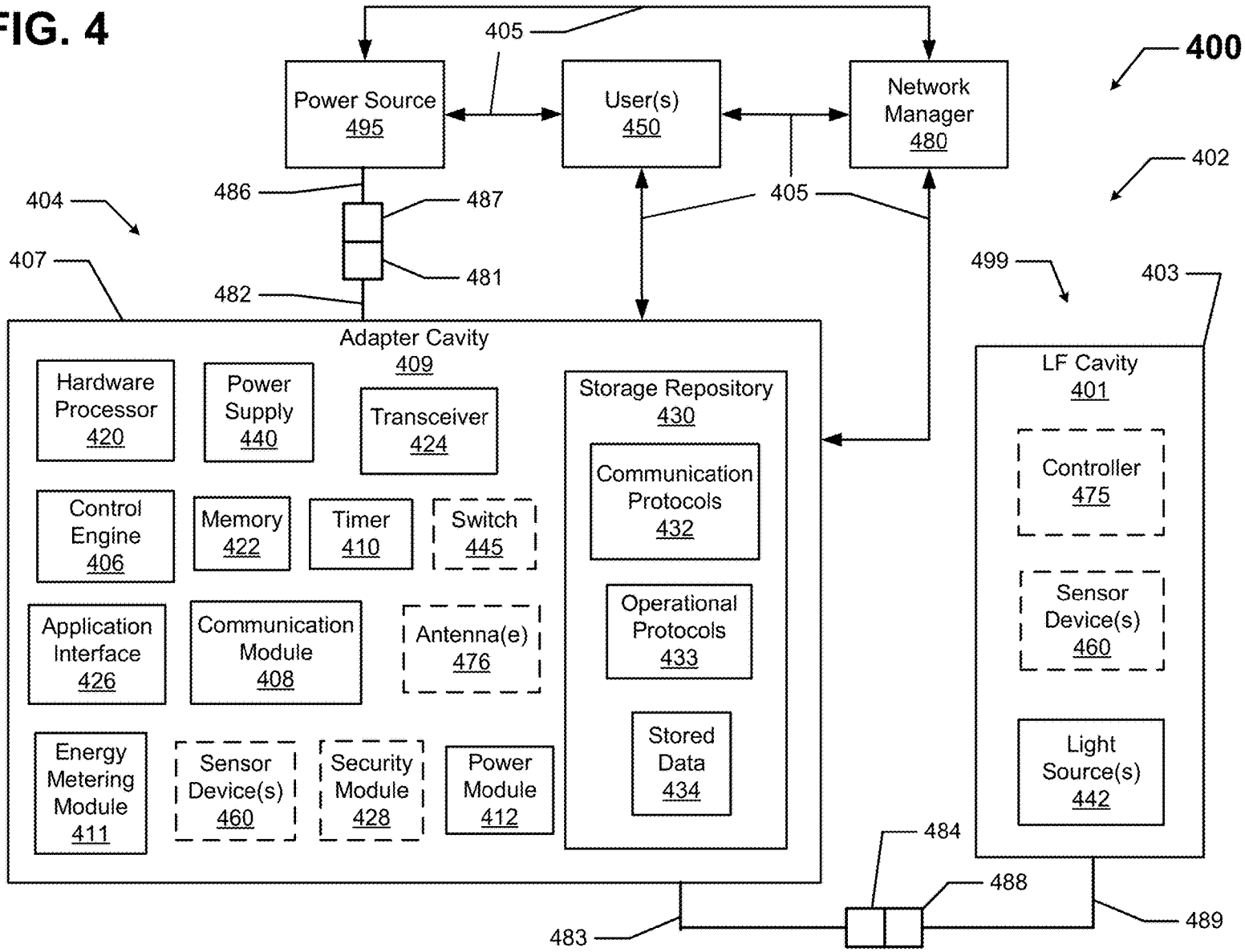
FIG. 4 shows a system diagram of a lighting system that includes a resulting light fixture in accordance with certain example embodiments.

FIG. 4 shows a system diagram of a lighting system 400 that includes a resulting light fixture 402 in accordance with certain example embodiments. In addition to the resulting light fixture 402, the lighting system 400 can include a power source 495, one or more users 450, and a network manager 480. The resulting light fixture 402 includes an example in-line adapter 404 and a base light fixture 499. The base light fixture 499 can include one or more of a number of components, such as one or more light sources 442, an optional controller 475, and one or more optional sensors 460. As discussed above with respect to FIGS. 2 and 3, the base light fixture 499 can be made of multiple portions that are mechanically (and in some cases electrically) coupled to each other. Alternatively, the base light fixture 499 can be a single portion.

The example in-line adapter 404 can include one or more of a number of components. Such components, can include, but are not limited to, a power supply 440, one or more sensor devices 460, a control engine 406, a communication module 408, a timer 410, an energy metering module 411, a power module 412, a storage repository 430, a hardware processor 420, a memory 422, a transceiver 424, an application interface 426, a switch 445, one or more antennae 476, and a security module 428. The components shown in FIG. 4 are not exhaustive, and in some embodiments, one or more of the components shown in FIG. 4 may not be included in an example in-line adapter 404, a base light fixture 499, or the resulting light fixture 402. Any component of the example in-line adapter 404, the base light fixture 499, and/or the resulting light fixture 402 can be discrete or combined with one or more other components of the in-line adapter 404, the base light fixture 499 and/or the resulting light fixture 402.

A user 450 may be any person that interacts with resulting light fixtures 402, base light fixtures 499, and/or example in-line adapters 404. Examples of a user 450 may include, but are not limited to, an engineer, an electrician, an instrumentation and controls technician, a mechanic, an operator, a property manager, a homeowner, a tenant, an employee, a consultant, a contractor, and a manufacturer's representative. The user 450 can include and use a user system (not shown, also called a user device), which may include a display (e.g., a GUI). The user 450 interacts with (e.g., sends data to, receives data from) the in-line adapter 404 and/or the base light fixture 499 of the retrofitted light fixture 402 via the application interface 426 (described below).

A user 450 can also interact with the network manager 480 and/or the power source 495. Interaction between the one or more users 450, the resulting light fixture 402 (including components thereof), the network manager 480, and the power source 495 can be conducted using communication links 405. Each communication link 405 can include wired (e.g., Class 1 electrical cables, Class 2 electrical cables, electrical connectors) and/or wireless (e.g., Wi-Fi, visible light communication, cellular networking, Bluetooth, Bluetooth Low Energy (BLE), Zigbee, WirelessHART, ISA100, Power Line Carrier, RS485, DALI) technology. For example, a communication link 405 can be (or include) a wireless link between the in-line adapter 404 and a user 450 (or associated user system). The communication link 405 can transmit signals (e.g., power signals, communication signals, control signals, data) between the resulting light fixture 402 and one or more of the users 450, the power source 495, and/or the network manager 480.

The network manager 480 is a device or component that controls all or a portion (e.g., a communication network) of the system 400 that includes the in-line adapter 404 of the resulting light fixture 402 (including components thereof), the power source 495, and the users 450. The network manager 480 can be substantially similar to the controller 475 and/or portions of the in-line adapter 404, as described below. For example, the network manager 480 can include a controller. Alternatively, the network manager 480 can include one or more of a number of features in addition to, or altered from, the features of the in-line adapter 404 or the controller 475 described below. As described herein, communication with the network manager 480 can include communicating with one or more other components (e.g., another light fixture) of the same system 400 or another system. In such a case, the network manager 480 can facilitate such communication. The network manager 480 can be called by other names, including but not limited to a master controller, a network controller, and an enterprise manager.

The power source 495 of the system 400 provides AC mains or other form of primary power to the resulting light fixture 402. In some cases, the power source 495 can also provide power to one or more other components (e.g., the network manager 480) of the system 400. The power source 495 can include one or more of a number of components. Examples of such components can include, but are not limited to, an electrical wire (similar to electrical wire 486), a coupling feature (similar to coupling feature 487), a transformer, an inductor, a resistor, a capacitor, a diode, a transistor, and a fuse. The power source 495 can be or include, for example, a wall outlet, an energy storage device (e.g. a battery, a supercapacitor), a circuit breaker, and an independent source of generation (e.g., a photovoltaic solar generation system). The power source 495 can also include one or more components (e.g., a switch, a relay, a controller) that allow the power source 495 to communicate with and/or follow instructions from a user 450, the in-line adapter 404, and/or the network manager 480.

As discussed above with respect to FIG. 3, the power source 495 can be detachably coupled to the in-line adapter 404. In this case, the power source 495 includes an electrical wire 486, at the distal end of which is disposed coupling feature 487. The in-line adapter 404 can include an electrical wire 482, at the distal end of which is disposed coupling feature 481. Coupling feature 487 and coupling feature 481 are complementary to each other and are detachably coupled to each other. In this way, the AC mains or other form of primary power provided by the power source 495 can be delivered directly to the in-line adapter 404. The coupling feature 481 and the electrical wire 482 of the in-line adapter 404 of FIG. 4 can be substantially the same as the coupling feature 381 and the electrical wire 382 of the in-line adapter 304 of FIG. 3.

In certain example embodiments, there can be more than one coupling feature 481-N (and, in some cases, one or more additional corresponding electrical wires 482-N) to receive input from multiple sources. For example, if the system 400 has multiple power sources 495 (e.g., an additional (secondary) power source 495 can be available when the primary power source 495 is unavailable (e.g., outage). In such a case, a switch 445 can be used to select which power source 495 to use at a particular point in time. In addition, or in the alternative, an additional coupling feature 481-N (and in some cases additional corresponding electrical wires 482-N) can be used to allow for wired control signals, communication signals, data transfer, and/or other suitable types of signals.

Similarly, as was the case in FIG. 3, the in-line adapter 404 can be detachably coupled to the base light fixture 499. In this case, the base light fixture 499 includes an electrical wire 489, at the distal end of which is disposed coupling feature 488. The in-line adapter 404 can include an electrical wire 483, at the distal end of which is disposed coupling feature 484. Coupling feature 488 and coupling feature 484 are complementary to each other and are detachably coupled to each other. In this way, the power provided by the power supply 440 (or by the power source 495 in the absence of the power supply 440) can be delivered directly to the base light fixture 499. The coupling feature 484 and the electrical wire 483 of the in-line adapter 404 of FIG. 4 can be substantially the same as the coupling feature 384 and the electrical wire 383 of the in-line adapter 304 of FIG. 3.

In certain example embodiments, there can be more than one coupling feature 484-N (and, in some cases, one or more additional corresponding electrical wires 483-N) to receive input from multiple sources. For example, if the system 400 has multiple base light fixtures 499-N that can also be enhanced by the one or more capabilities of the in-line adapter 404, then such additional coupling features 484-N can be used to provide those capabilities to those additional base light fixtures 499-N. In such a case, the capabilities of the in-line adapter 404 provided to the base light fixture 499 can be the same as, or different than, the capabilities provided to one or more of the other base light fixtures 499-N.

The one or more users 450, the network manager 480, the power source 495, and/or the sensor devices 460 can interact with the in-line adapter 404 of the resulting light fixture 402 using the application interface 426 in accordance with one or more example embodiments. Specifically, the application interface 426 of the in-line adapter 404 receives data (e.g., information, communications, instructions, updates to firmware) from and sends data (e.g., information, communications, instructions) to the one or more users 450, the network manager 480, the power source 495, the optional controller 475, and/or each sensor device 460. The one or more users 450, the network manager 480, the power source 495, and/or each sensor device 460 can include an interface to receive data from and send data to the in-line adapter 404 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The in-line adapter 404 (including components thereof, such as the power supply 440), the one or more users 450, the network manager 480, the power source 495, the optional controller 475, and/or the sensor devices 460 can use their own system or share a system in certain example embodiments. Such a system can be, or contain a form of, an Internet-based or an intranet-based computer system that is capable of communicating with various software. A computer system includes any type of computing device and/or communication device, including but not limited to the adapter 404. Examples of such a system can include, but are not limited to, a desktop computer with Local Area Network (LAN), Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 5.

Further, as discussed above, such a system can have corresponding software (e.g., user software, sensor software, controller software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the system 400.

The resulting light fixture 402 can include a light fixture housing 403, which is substantially the same as the housing of the base light fixture 499, and which is substantially the same as the housing 203 of FIG. 2 and the housing 303 of FIG. 3 above. The light fixture housing 403 (also sometimes abbreviated LF housing 403) can include at least one wall that forms a light fixture cavity 401 (also sometimes abbreviated LF cavity 401). In some cases, the light fixture housing 403 can be designed to comply with any applicable standards so that the resulting light fixture 402 can be located in a particular environment. The light fixture housing 403 can form any type of resulting light fixture 402, including but not limited to a troffer light fixture, a down can light fixture, a recessed light fixture, and a pendant light fixture. The light fixture housing 403 can also be used to combine the resulting light fixture 402 with some other device, including but not limited to a ceiling fan, a smoke detector, a broken glass detector, a garage door opener, and a wall clock.

The light fixture housing 403 of the resulting light fixture 402 can be used to house one or more components of the resulting light fixture 402, including the in-line adapter 404. An example of this is shown in FIG. 3 above. Alternatively, as shown in FIG. 4, the in-line adapter 404 (which in this case includes the power supply 440, the control engine 406, the communication module 408, the timer 410, the energy metering module 411, the power module 412, the storage repository 430, the hardware processor 420, the memory 422, the transceiver 424, the application interface 426, the optional switch 445, one or more optional antennae 476, and the optional security module 428, and one or more optional sensor devices 460) can be disposed outside of the light fixture cavity 401 formed by the housing 403. In such a case, the adapter housing 407, discussed below, can also be designed to comply with any applicable standards so that the in-line adapter 404 can be located in a particular environment. In alternative embodiments, any one or more of these or other components (e.g., a sensor device 460) of the resulting light fixture 402 can be disposed on the light fixture housing 403 and/or remotely from, but in communication with, the light fixture housing 403.

Similarly, the in-line adapter 404 can include an adapter housing 407, which is substantially the same as the adapter housing described above with respect to FIGS. 1A through 3. The adapter housing 407 can include at least one wall that forms an adapter cavity 409. One or more of the various components (e.g., power supply 440, control engine 406, hardware processor 420) of the in-line adapter 404 can be disposed within the adapter cavity 409. Alternatively, a component of the in-line adapter 404 can be disposed on the adapter housing 407 or can be located remotely from, but in communication with, the adapter housing 407. In some cases, the in-line adapter 404, or portions thereof, can be disposed in another enclosure (e.g., a junction box, a control panel) that is separate from the housing 403 of the base light fixture 499.

Regardless of whether the various components of the in-line adapter 404 are disposed on, within, or outside the housing 407, one or more of the components shown in FIG. 4 can be combined with one or more other components. For example, the control engine 406, the storage repository 430, the hardware processor 420, the memory 422, the communication module 408, the transceiver 424, the power module 412, the timer 410, and the energy metering module 411 can be integrated with the power supply 440. As another example, the control engine 406, the storage repository 430, the hardware processor 420, the memory 422, the communication module 408, the transceiver 424, the power module 412, the timer 410, and the energy metering module 411 can be part of a controller, such as optional controller 475 of the base light fixture 499.

One or more of the components shown for the in-line adapter 404 of FIG. 4 can be optional. For example, an in-line adapter 404 may include only a power supply 440. As another example, an in-line adapter 404 may include only a sensor device 460. As yet another example, an in-line adapter 404 may include only a control engine 406, which can occur in the absence of the optional controller 475 of the base light fixture 499. As still another example, an in-line adapter 404 may include only communication-related components (e.g., the transceiver 424, the communication module 408, an antenna 476).

Example embodiments of in-line adapters 404 are designed add, enhance, and/or replace one or more capabilities of the base light fixture 499 to result in the resulting light fixture 402. The example in-line adapter 404, using the coupling features 481 and 484 (e.g., electrical connectors) allow a user 450 to insert the in-line adapter 404 between the power supply 495 and the base light fixture 499 with minimal effort and without the use of tools, allowing for a "plug-and-play" insertion and removal of the in-line adapter 404 and its related functionality.

The one or more sensor devices 460 of the in-line adapter 404 can include one or more of any type of sensor that measure one or more parameters. Examples of types of sensors of a sensor device 460 can include, but are not limited to, a passive infrared sensor, a photocell, a differential pressure sensor, a humidity sensor, a pressure sensor, an air flow monitor, a gas detector, and a resistance temperature detector. Parameters that can be measured by a sensor of a sensor device 460 can include, but are not limited to, movement, occupancy, ambient light, infrared light, temperature within the housing 403 of the base light fixture 499, and ambient temperature. The parameters measured by the sensors of the sensor devices 460 can be used by one or more components (e.g., the power supply 440, the control engine 406) of the in-line adapter 404 and/or by one or more components (e.g., the light sources 442, the controller 475) of the base light fixture 499. Such measurements can be used to operate the resulting light fixture 402. Alternatively, such measurements can be used for a device or system outside of the resulting light fixture 402.

A sensor device 460 can be part of the base light fixture 499. In such a case, the control engine 406 of the in-line adapter 404 and/or the controller 475 of the base light fixture 499 can be configured to communicate with (and in some cases control) the sensor device 460. In some other cases, a sensor device 460 can be part of the in-line adapter 404 (e.g., disposed within the adapter cavity 409, disposed on the adapter housing 407), where the control engine 406 of the in-line adapter 404 and/or the controller 475 of the base light fixture 499 can be configured to communicate with (and in some cases control) the sensor device 460. As yet another alternative, a sensor device 460 can be a new device that is added to the resulting light fixture 402 along with but remotely from the in-line adapter 404, where the control engine 406 of the in-line adapter 404 and/or the controller 475 of the base light fixture 499 are configured to communicate with (and in some cases control) the sensor device 460. Each sensor device 460 can use one or more of a number of communication protocols for sending and receiving communication signals.

In certain example embodiments, the power supply 440 of the in-line adapter 404 receives power from the power source 495. The power supply 440 uses the power it receives to generate and provide power (also called final power herein) to one or more other components (e.g., the power module 412, a sensor device 460) of the in-line adapter 404 and/or one or more components (e.g., the light sources 442) of the base light fixture 499. The power supply 440 can be called by any of a number of other names, including but not limited to a driver, a LED driver, and a ballast. The power supply 440 can include one or more of a number of single or multiple discrete components (e.g., transistor, diode, resistor), and/or a microprocessor. The power supply 440 may include a printed circuit board, upon which the microprocessor and/or one or more discrete components are positioned.

In some cases, the power supply 440 can include one or more components (e.g., a transformer, a diode bridge, an inverter, a converter) that receives power from the in-line adapter 404 and generates power of a type (e.g., alternating current, direct current) and level (e.g., 12V, 24V, 120V) that can be used by one or more other components (e.g., the power module 412, a sensor device 460) of the in-line adapter 404 and/or one or more components (e.g., the light sources 442) of the base light fixture 499. In addition, or in the alternative, the power supply 440 can be or include a source of power in itself. For example, the power supply 440 can or include be a battery, a localized photovoltaic solar power system, or some other source of independent power.

Each optional antenna 4765 of the in-line adapter 404 is a component that converts electrical power to signals (for transmitting) and signals to electrical power (for receiving). In transmission, a radio transmitter (e.g., transceiver 424) supplies an electric current oscillating at radio frequency (i.e. a high frequency alternating current (AC)) to the terminals of the antenna 476, and the antenna 476 radiates the energy from the current as signals. In reception, an antenna 476 intercepts some of the power of signals in order to produce a tiny voltage at its terminals, which is applied through the switch 445 to a receiver (e.g., transceiver 424) to be amplified.

An optional antenna 476 can typically consist of an arrangement of electrical conductors that are electrically connected to each other (often through a transmission line) to create a body of the antenna 476. The body of the antenna 476 is electrically coupled to the transceiver 424. An oscillating current of electrons forced through the body of an antenna 476 by the transceiver 424 will create an oscillating magnetic field around the body, while the charge of the electrons also creates an oscillating electric field along the body of the antenna 476. These time-varying fields radiate away from the antenna 476 into space as a moving transverse signal (e.g., an electromagnetic field wave). Conversely, during reception, the oscillating electric and magnetic fields of an incoming signal create oscillating currents in the antenna 476.

In certain example embodiments, an antenna 476 can be disposed at, within, or on any portion of the in-line adapter 404. For example, an antenna 375 can be disposed on the housing 407 of the in-line adapter 404 and extend away from the housing 407 of the in-line adapter 404. As another example, an antenna 476 can be insert molded into a lens of a sensor device 460 mounted on the housing 407 of the in-line adapter 404. As another example, an antenna 476 can be two-shot injection molded into the housing 407 of the in-line adapter 404. As yet another example, an antenna 476 can be adhesive mounted onto the housing 407 of the in-line adapter 404. As still another example, an antenna 476 can be pad printed onto a circuit board within the cavity 409 formed by the housing 407 of the in-line adapter 404. As yet another example, an antenna 476 can be a chip ceramic antenna that is surface mounted. As still another example, an antenna 476 can be a wire antenna.

The optional switch 445 can be a single switch device or a number of switch devices arranged in series and/or in parallel with each other. The switch 445 determines a setting of a parameter (e.g., CCT, lumen output, dimming range) that effects the output of the one or more light sources 442. A switch 445 can have one or more contacts, where each contact has an open state and a closed state (position). In the open state, a contact of the switch 445 creates an open circuit. In the closed state, a contact of the switch 445 creates a closed circuit. In certain example embodiments, the position of each contact of the optional switch 445 is controlled by the control engine 406. Alternatively, the switch 445 can be physically or communicably accessible to a user 450 so that the user 450 can control the position of the switch 445. If the switch 445 is a single device, the switch 445 can have a single contact or multiple contacts. In any case, only one contact of the switch 445 can be active (closed) at any point in time in certain example embodiments. Consequently, when one contact of the switch 445 is closed, all other contacts of the switch 445 are open in such example embodiments.

The storage repository 430 can be a persistent storage device (or set of devices) that stores software and data used to assist the in-line adapter 404 in communicating with the one or more users 450, the network manager 480, the power source 495, the optional controller 475, and one or more optional sensor devices 460 within the system 400. In one or more example embodiments, the storage repository 430 stores one or more communication protocols 432, one or more operational protocols 433, and stored data 434. The communication protocols 432 can be any of a number of protocols that are used to send and/or receive data between the adapter 404 and the one or more users 450, the network manager 480, the power source 495, the optional controller 475, and one or more optional sensor devices 460. One or more of the communication protocols 432 can be a time-synchronized protocol. Examples of such time-synchronized protocols can include, but are not limited to, a highway addressable remote transducer (HART) protocol, a wirelessHART protocol, and an International Society of Automation (ISA) 100 protocol. In this way, one or more of the communication protocols 432 can provide a layer of security to the data transferred within the system 400.

The operational protocols 433 can be any algorithms, formulas, logic steps, and/or other similar operational procedures that the control engine 406 of the in-line adapter 404 (and, if included, the controller 475 of the base light fixture 499) follows based on certain conditions at a point in time. An example of an operational protocol 433 is directing the control engine 406 to provide power and to cease providing power from the power supply 440 to the light sources 442 at pre-set points of time. Another example of an operational protocol 433 is directing the control engine 406 to adjust the amount of power delivered by the power supply 440 to one or more of the light sources 442, thereby acting as a dimmer.

Yet another example of an operational protocol 433 is to instruct the control engine 406 how and when to tune the color output by one or more of the light sources 442 of the resulting light fixture 402. Still another example of an operational protocol 433 is to check one or more communication links 405 with the network manager 480 and, if a communication link 405 is not functioning properly, allow the in-line adapter 404 to operate autonomously from the rest of the system 400.

As another example of an operational protocol 433, configurations of the in-line adapter 404 can be stored in memory 422 (e.g., non-volatile memory) so that the in-line adapter 404 (or portions thereof) can operate regardless of whether the in-line adapter 404 is communicating with the network manager 480 and/or other components in the system 400. Still another example of an operational protocol 433 is identifying an adverse condition or event (e.g., excessive humidity, no pressure differential, extreme pressure differential, high temperature) based on measurements taken by a sensor device 460. In such a case, the controller 404 can notify the network manager 480 and/or one or more of the users 450 as to the adverse condition or event identified. Yet another example of an operational protocol 433 is to have the in-line adapter 404 operate in an autonomous control mode if one or more components (e.g., the communication module 408, the transceiver 424) of the in-line adapter 404 that allows the in-line adapter 404 to communicate with another component of the system 400 fails.

Stored data 434 can be any data, aside from operational protocols 433 or communication protocols 432. Stored data 434 can be past or historical data, present data, or forecasts. Stored data 434 can be associated with any of a number of components of the system, and of the in-line adapter 404 in particular. For example, stored data 434 can include measurements made by (e.g., collected by) each sensor device 460 that is communicably coupled to the in-line adapter 404 and/or the optional controller 475. Stored data 434 can also include, but is not limited to, a manufacturer of the sensor device 460 and/or other component, a model number of the sensor device 460 and/or other component, communication capability of a sensor device 460 and/or other component, power requirements of a sensor device 460 and/or other component, and measurements taken by the sensor device 460. Other examples of stored data 434 can include, but are not limited to, user preferences, threshold values, algorithms, results of algorithms, tables, and default values.

Examples of a storage repository 430 can include, but are not limited to, a database (or a number of databases), a file system, a hard drive, flash memory, cloud-based storage, some other form of solid state data storage, or any suitable combination thereof. The storage repository 430 can be located on multiple physical machines, each storing all or a portion of the communication protocols 432, the operational protocols 433, and/or the stored data 434 according to some example embodiments. Each storage unit or device can be physically located in the same or in a different geographic location.

The storage repository 430 can be operatively connected to the control engine 406. In one or more example embodiments, the control engine 406 includes functionality to communicate with the one or more users 450, the network manager 480, the power source 495, the optional controller 475, and the optional sensor devices 460 in the system 400. More specifically, the control engine 406 sends information to and/or receives information from the storage repository 430 in order to communicate with the one or more users 450, the network manager 480, the power source 495, the optional controller 475, and the optional sensor devices 460. As discussed below, the storage repository 430 can also be operatively connected to the communication module 408 in certain example embodiments.

In certain example embodiments, the control engine 406 of the adapter 404 controls the operation of one or more components (e.g., the power supply 440, the communication module 408, the timer 410, the transceiver 424) of the in-line adapter 404. For example, the control engine 406 can activate the communication module 408 when the communication module 408 is in "sleep" mode and when the communication module 408 is needed to send data received from another component (e.g., a sensor 460, the user 450) in the system 400. As another example, the control engine 406 can operate one or more sensor devices 460 to dictate when measurements are taken by the sensor devices 460 and when those measurements are communicated by the sensor devices 460 to the control engine 406.

As another example, the control engine 406 can control the power supply 440. In such a case, the control engine 406 can control when and in what amount of power the power supply 400 provides power to one or more components (e.g., the light sources 442) of the resulting light fixture 402. As yet another example, the control engine 406 can acquire the current time using the timer 410. The timer 410 can enable the in-line adapter 404 to control the resulting light fixture 402 even when the in-line adapter 404 has no communication with the network manager 480.

As another example, the control engine 406 can check one or more communication links 405 between the in-line adapter 404 and the network manager 480 and, if a communication link 405 is not functioning properly, allow the in-line adapter 404 to operate autonomously from the rest of the system 400. As yet another example, the control engine 406 can store configurations of the in-line adapter 404 (or portions thereof) in memory 422 (e.g., non-volatile memory) so that the in-line adapter 404 (or portions thereof) can operate regardless of whether the in-line adapter 404 is communicating with the network manager 480 and/or other components in the system 400.

As still another example, the control engine 406 can obtain readings from an adjacent sensor device if the sensor device 460 associated with the resulting light fixture 402 malfunctions, if the communication link 405 between the sensor device 460 and the in-line adapter 404 fails, and/or for any other reason that the readings of the sensor device 460 associated with the resulting light fixture 402 fails to reach the in-line adapter 404 and/or optional controller 475. To accomplish this, for example, the network manager 480 can instruct, upon a request from the control engine 406, the adjacent sensor device 460 to communicate its readings to the control engine 406 of the in-line adapter 404 using communication links 405. As still another example, the control engine 406 can cause the in-line adapter 404 to operate in an autonomous control mode if one or more components (e.g., the communication module 408, the transceiver 424) of the in-line adapter 404 that allows the in-line adapter 404 to communicate with another component of the system 400 fails. Similarly, the control engine 406 of the in-line adapter 404 can control at least some of the operation of one or more adjacent light fixtures in the system 400.

The control engine 406 can provide control, communication, and/or other similar signals to one or more of the users 450, the network manager 480, the power source 495, the optional controller 475, and one or more of the optional sensor devices 460. Similarly, the control engine 406 can receive control, communication, and/or other similar signals from one or more of the users 450, the network manager 480, the power source 495, the optional controller 475, and one or more of the optional sensor devices 460. The control engine 406 can control each sensor device 460 automatically (for example, based on one or more algorithms and/or protocols stored in the storage repository 430) and/or based on control, communication, and/or other similar signals received from another device through a communication link 405. The control engine 406 may include a printed circuit board, upon which the hardware processor 420 and/or one or more discrete components of the in-line adapter 404 are positioned.

In certain example embodiments, the control engine 406 can include an interface that enables the control engine 406 to communicate with one or more components (e.g., power supply 440) of the resulting light fixture 402. For example, if the power supply 440 of the resulting light fixture 402 operates under IEC Standard 62386, then the power supply 440 can include a digital addressable lighting interface (DALI). In such a case, the control engine 406 can also include a DALI to enable communication with the power supply 440 within the resulting light fixture 402. Such an interface can operate in conjunction with, or independently of, the communication protocols 432 used to communicate between the in-line adapter 404 and one or more of the users 450, the network manager 480, the power source 495, the optional controller 475, and the optional sensor devices 460.

The control engine 406 (or other components of the in-line adapter 404) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit (VC), and a pulse width modulator (PWM).

The communication module 408 of the in-line adapter 404 determines and implements the communication protocol (e.g., from the communication protocols 432 of the storage repository 430) that is used when the control engine 406 communicates with (e.g., sends signals to, receives signals from) one or more of the users 450, the network manager 480, the power source 495, the optional controller 475, and/or one or more of the sensor devices 460. In some cases, the communication module 408 accesses the storage repository 430 to determine which communication protocol 432 is used to communicate with a sensor device 460. In addition, the communication module 408 can interpret the communication protocol 432 of a communication received by the in-line adapter 404 so that the control engine 406 can interpret the communication.

The communication module 408 can send and receive data between the network manager 480, the power source 495, the optional controller 475, the sensor devices 460, and/or the users 450 and the in-line adapter 404. The communication module 408 can send and/or receive data in a given format that follows a particular communication protocol 432. The control engine 406 can interpret the data packet received from the communication module 408 using the communication protocol 432 information stored in the storage repository 430. The control engine 406 can also facilitate the data transfer between the power supply 440 and/or one or more sensor devices 460 and the network manager 480, the power source 495, the optional controller 475, and/or a user 450 by converting the data into a format understood by the communication module 408.

The communication module 408 can send data (e.g., communication protocols 432, operational protocols 433, stored data 434, operational information, error codes) directly to and/or retrieve data directly from the storage repository 430. Alternatively, the control engine 406 can facilitate the transfer of data between the communication module 408 and the storage repository 430. The communication module 408 can also provide encryption to data that is sent by the in-line adapter 404 and decryption to data that is received by the in-line adapter 404. The communication module 408 can also provide one or more of a number of other services with respect to data sent from and received by the in-line adapter 404. Such services can include, but are not limited to, data packet routing information and procedures to follow in the event of data interruption.

The timer 410 of the in-line adapter 404 can track clock time, intervals of time, an amount of time, and/or any other measure of time. The timer 410 can also count the number of occurrences of an event, whether with or without respect to time. Alternatively, the control engine 406 can perform the counting function. The timer 410 is able to track multiple time measurements concurrently. The timer 410 can track time periods based on an instruction received from the control engine 406, based on an instruction received from a user 450, based on an instruction programmed in the software for the in-line adapter 404, based on some other condition or from some other component, or from any combination thereof.

The timer 410 can be configured to track time when there is no power delivered to the in-line adapter 404 (e.g., the power module 412 malfunctions) using, for example, a super capacitor or a battery backup. In such a case, when there is a resumption of power delivery to the in-line adapter 404, the timer 410 can communicate any aspect of time to the in-line adapter 404. In such a case, the timer 410 can include one or more of a number of components (e.g., a super capacitor, an integrated circuit) to perform these functions.

The energy metering module 411 of the in-line adapter 404 measures one or more components of power (e.g., current, voltage, resistance, VARs, watts) at one or more points (e.g., coupling feature 481 of the in-line adapter 404, coupling feature 484 of the in-line adapter 404, output of the power supply 440) associated with the in-line adapter 404 or, more generally, the resulting light fixture 402. The energy metering module 411 can include any of a number of measuring devices and related devices, including but not limited to a voltmeter, an ammeter, a power meter, an ohmmeter, a current transformer, a potential transformer, and electrical wiring. The energy metering module 411 can measure a component of power continuously, periodically, based on the occurrence of an event, based on a command received from the control engine 406, and/or based on some other factor.

The power module 412 of the in-line adapter 404 provides power to one or more other components (e.g., timer 410, control engine 406) of the in-line adapter 404. In addition, in certain example embodiments, the power module 412 can provide power to the power supply 440 of the in-line adapter 404. The power module 412 can include one or more of a number of single or multiple discrete components (e.g., transistor, diode, resistor), and/or a microprocessor. The power module 412 may include a printed circuit board, upon which the microprocessor and/or one or more discrete components are positioned. In some cases, the power module 412 can include one or more components that allow the power module 412 to measure one or more elements of power (e.g., voltage, current) that is delivered to and/or sent from the power module 412.

The power module 412 can include one or more components (e.g., a transformer, a diode bridge, an inverter, a converter) that receives power (e.g., AC mains) from the power source 495 (in the absence of the power supply 440) or from the power supply 440. The power module 412 can use this power to generate power of a type (e.g., alternating current, direct current) and level (e.g., 12V, 24V, 120V) that can be used by the other components of the in-line adapter 404 and, in some cases, one or more components (e.g., a sensor device 460, the controller 475) of the base light fixture 499. In addition, or in the alternative, the power module 412 can be or include a source of power in itself to provide signals to the other components of the in-line adapter 404 and/or one or more components of the base light fixture 499. For example, the power module 412 can be or include a battery or other form of energy storage device. As another example, the power module 412 can be or include a localized photovoltaic solar power system.

In certain example embodiments, the power module 412 of the in-line adapter 404 can also provide power and/or control signals, directly or indirectly, to one or more of the sensor devices 460. In such a case, the control engine 406 can direct the power generated by the power module 412 to one or more sensor devices 460 of the resulting light fixture 402. In this way, power can be conserved by sending power to the sensor devices 460 of the resulting light fixture 402 when those devices need power, as determined by the control engine 406.

The hardware processor 420 of the in-line adapter 404 executes software, algorithms, and firmware in accordance with one or more example embodiments. Specifically, the hardware processor 420 can execute software on the control engine 406 or any other portion of the in-line adapter 404, as well as software used by one or more of the users 450, the network manager 480, the power source 495, the optional controller 475, and/or one or more of the sensor devices 460. The hardware processor 420 can be an integrated circuit, a central processing unit, a multi-core processing chip, SoC, a multi-chip module including multiple multi-core processing chips, or other hardware processor in one or more example embodiments. The hardware processor 420 is known by other names, including but not limited to a computer processor, a microprocessor, and a multi-core processor.

In one or more example embodiments, the hardware processor 420 executes software instructions stored in memory 422. The memory 422 includes one or more cache memories, main memory, and/or any other suitable type of memory. The memory 422 can include volatile and/or non-volatile memory. The memory 422 can be discretely located within the in-line adapter 404 relative to the hardware processor 420 according to some example embodiments. In certain configurations, the memory 422 can be integrated with the hardware processor 420.

In certain example embodiments, the in-line adapter 404 does not include a hardware processor 420. In such a case, the in-line adapter 404 can include, as an example, one or more field programmable gate arrays (FPGA), one or more insulated-gate bipolar transistors (IGBTs), and/or one or more integrated circuits (ICs). Using FPGAs, IGBTs, ICs, and/or other similar devices known in the art allows the in-line adapter 404 (or portions thereof) to be programmable and function according to certain logic rules and thresholds without the use of a hardware processor. Alternatively, FPGAs, IGBTs, ICs, and/or similar devices can be used in conjunction with one or more hardware processors 420.

The transceiver 424 of the in-line adapter 404 can send and/or receive control and/or communication signals. Specifically, the transceiver 424 can be used to transfer data between the in-line adapter 404 and one or more of the users 450, the network manager 480, the power source 495, the power supply 440, the optional controller 475, and/or the sensor devices 460. The transceiver 424 can use wired and/or wireless technology. The transceiver 424 can be configured in such a way that the control and/or communication signals sent and/or received by the transceiver 424 can be received and/or sent by another transceiver that is part of one or more of the users 450, the network manager 480, the power source 495, the power supply 440, the optional controller 475, and/or the sensor devices 460. The transceiver 424 can use any of a number of signal types, including but not limited to radio frequency signals and visible light signals.

When the transceiver 424 uses wireless technology, any type of wireless technology can be used by the transceiver 424 in sending and receiving signals. Such wireless technology can include, but is not limited to, Wi-Fi, visible light communication, cellular networking, BLE, Zigbee, and Bluetooth. The transceiver 424 can use one or more of any number of suitable communication protocols (e.g., ISA100, HART) when sending and/or receiving signals. Such communication protocols can be stored in the communication protocols 432 of the storage repository 430. Further, any transceiver information for one or more of the users 450, the network manager 480, the power source 495, the power supply 440, the optional controller 475, and/or the sensor devices 460 can be part of the communication protocols 432 (or other areas) of the storage repository 430.

Optionally, in one or more example embodiments, the security module 428 secures interactions between the in-line adapter 404 (including components thereof), one or more of the users 450, the network manager 480, the power source 495, and/or the sensors 460. More specifically, the security module 428 authenticates communication from software based on security keys verifying the identity of the source of the communication. For example, user software may be associated with a security key enabling the software of the user 450 to interact with the adapter 404. Further, the security module 428 can restrict receipt of information, requests for information, and/or access to information in some example embodiments.

As mentioned above, the resulting light fixture 402 is a combination of the in-line adapter 404 and the base light fixture 499. The base light fixture 499 can include one or more of a number of components, including but not limited to one or more optional sensor devices 460, the optional controller 475, and one or more light sources 442. The optional sensor devices 460 of the base light fixture 499 can be substantially the same as the sensor devices 460 of the in-line adapter 404 described above. The light sources 442 of the resulting light fixture 402 are devices and/or components typically found in a light fixture to allow the resulting light fixture 402 to operate. The light sources 442 emit light using power provided by the power supply 440. The resulting light fixture 402 can have one or more of any number and/or type (e.g., light-emitting diode, incandescent, fluorescent, halogen) of light sources 442. A light source 442 can vary in the amount and/or color of light that it emits.

The base light fixture 499 can also include one or more of a number of other components. Examples of such other components can include, but are not limited to, a heat sink, an electrical conductor or electrical cable, a terminal block, a lens, a diffuser, a reflector, an air moving device, a baffle, and a circuit board.

As stated above, the resulting light fixture 402 can be placed in any of a number of environments. In such a case, the housing 403 of the base light fixture 499 and/or the housing 407 of the in-line adapter 404 can be configured to comply with applicable standards for any of a number of environments. For example, the base light fixture 499 and/or the housing 407 of the in-line adapter 404 can be rated as a Division 1 or a Division 2 enclosure under NEC standards. Similarly, any of the sensor devices 460 (when remotely located or at least partially exposed to the ambient environment) or other devices communicably coupled to the resulting light fixture 402 can be configured to comply with applicable standards for any of a number of environments. For example, a sensor device 460 can be rated as a Division 1 or a Division 2 enclosure under NEC standards.

Figure 5:
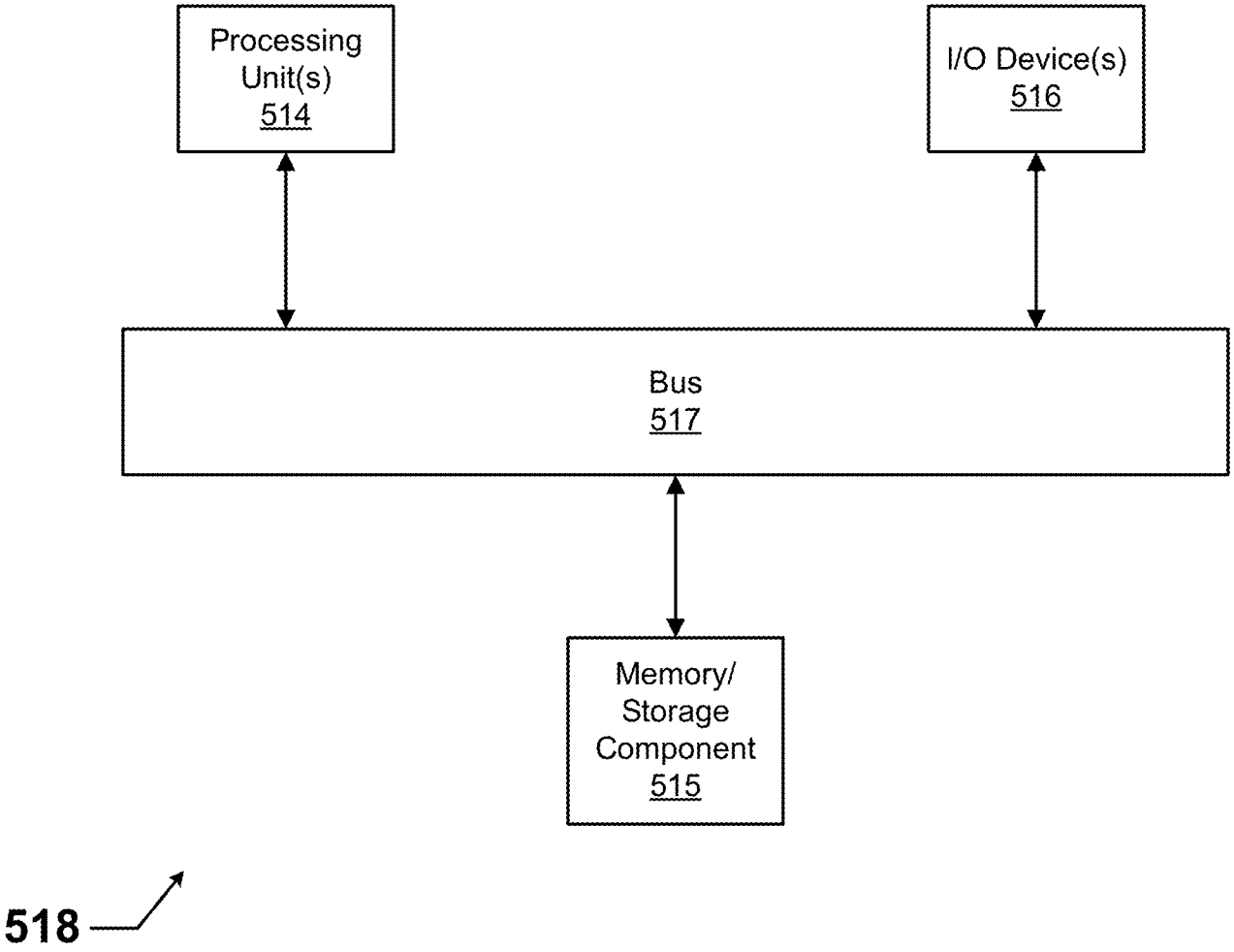
FIG. 5 shows a computing device in accordance with certain example embodiments.

FIG. 5 illustrates one embodiment of a computing device 518 that implements one or more of the various techniques described herein, and which is representative, in whole or in part, of the elements described herein pursuant to certain example embodiments. For example, the in-line adapter 404 of FIG. 4 (including components thereof, such as the control engine 406, the hardware processor 420, the storage repository 430, the power supply 440, and the transceiver 424) can be considered a computing device 518. Computing device 518 is one example of a computing device and is not intended to suggest any limitation as to scope of use or functionality of the computing device and/or its possible architectures. Neither should computing device 518 be interpreted as having any dependency or requirement relating to any one or combination of components illustrated in the example computing device 518.

Computing device 518 includes one or more processors or processing units 514, one or more memory/storage components 515, one or more input/output (I/O) devices 516, and a bus 517 that allows the various components and devices to communicate with one another. Bus 517 represents one or more of any of several types of bus structures, including a memory bus or memory controller, a peripheral bus, an accelerated graphics port, and a processor or local bus using any of a variety of bus architectures. Bus 517 includes wired and/or wireless buses.

Memory/storage component 515 represents one or more computer storage media. Memory/storage component 515 includes volatile media (such as random access memory (RAM)) and/or nonvolatile media (such as read only memory (ROM), flash memory, optical disks, magnetic disks, and so forth). Memory/storage component 515 includes fixed media (e.g., RAM, ROM, a fixed hard drive, etc.) as well as removable media (e.g., a Flash memory drive, a removable hard drive, an optical disk, and so forth).

One or more I/O devices 516 allow a customer, utility, or other user to enter commands and information to computing device 518, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 518 is connected to a network (not shown) (e.g., a local area network (LAN), a wide area network (WAN) such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer system 518 includes at least the minimal processing, input, and/or output means necessary to practice one or more embodiments.

Further, those skilled in the art will appreciate that one or more elements of the aforementioned computer device 518 is located at a remote location and connected to the other elements over a network in certain example embodiments. Further, one or more embodiments is implemented on a distributed system having one or more nodes, where each portion of the implementation (e.g., power supply 440, control engine 406) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

Example embodiments of in-line adapters described herein allow for an upgrade or an addition in capability of a base (e.g., existing) light fixture to arrive at a resulting light fixture. Example in-line adapters include coupling features (e.g., electrical connectors) that do not require the use of tools, making alterations to a base light fixture relatively user-friendly. As a result of the varying capabilities of example in-line adapters, example embodiments can also prolong the life and functionality of a resulting light fixture, increase the reliability of the resulting light fixture, reduce overall power consumption, improve communication efficiency, have an ease of installation, have an ease of maintenance, and comply with industry standards that apply to light fixtures located in certain environments. Example embodiments can also allow for a more modular approach to assembling, configuring, and/or upgrading light fixtures, which can result in fewer inventory items while allowing for a greater number of configurations and features.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A resulting light fixture, comprising:

a base light fixture comprising at least one light source and a first coupling feature, wherein the first coupling feature is configured to detachably couple to a second coupling feature of a power source; and an in-line adapter comprising at least one light fixture component, a third coupling feature, and a fourth coupling feature, wherein the third coupling feature is detachably coupled to the first coupling feature of the base light fixture, wherein the fourth coupling feature is configured to detachably couple to the second coupling feature of the power source, wherein the at least one light fixture component provides a capability absent in the base light fixture, and wherein the second coupling feature of the power source and the first coupling feature of the base light fixture are configured to couple directly to each other in the absence of the in-line adapter.

2. The resulting light fixture of claim 1, wherein at least one light fixture component comprises a transceiver that communicates using wireless communication.

3. The resulting light fixture of claim 2, wherein the at least one light fixture component further comprises at least one antenna for transmitting and receiving wireless signals.

4. The resulting light fixture of claim 1, wherein the at least one light fixture component comprises a sensor device that measures one or more parameters that are used outside of operating the at least one light source.

5. The resulting light fixture of claim 1, wherein the at least one light fixture component comprises a sensor device that measures one or more parameters that are used to operate the at least one light source.

6. The resulting light fixture of claim 1, wherein the at least one light fixture component comprises a switch.

7. The resulting light fixture of claim 6, wherein the switch is used to select a setting associated with light emitted by the at least one light source.

8. The resulting light fixture of claim 1, wherein the at least one light fixture component comprises a control engine configured to control the at least one light source.

9. The resulting light fixture of claim 1, wherein the in-line adapter is disposed within a housing of the base light fixture.

10. The resulting light fixture of claim 1, wherein the in-line adapter is disposed outside of the housing of the base light fixture.

11. The resulting light fixture of claim 1, wherein the base light fixture is an existing light fixture, and wherein the in-line adapter retrofits the base light fixture.

12. An in-line adapter for a light fixture, the in-line adapter comprising:

a first coupling feature configured to detachably couple to a second coupling feature of a power source that provides primary power;

a third coupling feature configured to detachably couple to a fourth coupling feature of a base light fixture portion; and an adapter housing coupled to and disposed between the first coupling feature and the second coupling feature, wherein the adapter housing forms a cavity in which at least one light fixture component is disposed, wherein the at least one light fixture component provides a capability absent in the base light fixture portion, and wherein the second coupling feature and the fourth coupling feature, in the absence of the first coupling feature and the third coupling feature, are configured to detachably couple directly to each other.

13. The in-line adapter of claim 12, wherein the first coupling feature comprises a first connector end, and wherein the second coupling feature comprises a first complementary connector end.

14. The in-line adapter of claim 13, further comprising:

at least one electrical wire disposed between the first connector end and the adapter housing, wherein the at least one electrical wire is configured to transmit the primary power from the first connector end to the at least one light fixture component.

15. The in-line adapter of claim 12, wherein the third coupling feature comprises a second connector end, and wherein the fourth coupling feature comprises a second complementary connector end.

16. The in-line adapter of claim 15, further comprising:

at least one electrical wire disposed between the second connector end and the adapter housing, wherein the at least one electrical wire is configured to transmit signals from the at least one light fixture component to the second connector end.

17. The in-line adapter of claim 12, wherein the at least one light fixture component is disposed within the adapter housing.

18. The in-line adapter of claim 12, wherein the third coupling feature is disposed on the adapter housing.

19. A resulting light fixture, comprising:

a base light fixture comprising at least one light source and at least one first coupling feature; and an in-line adapter comprising a dimming controller, a second coupling feature, and a third coupling feature, wherein the second coupling feature is detachably coupled to the first coupling feature of the base light fixture, wherein the third coupling feature is configured to detachably couple to a fourth coupling feature of a power source, and wherein the dimming controller provides a capability to dim the at least one light source that is absent in the base light fixture without the in-line adapter.

20. The resulting light fixture of claim 19, wherein the dimming controller further provides the capability to turn the at least one light source on and off.

* * * * *